US012781475B2

(12) United States Patent
Gerth et al.

(10) Patent No.: US 12,781,475 B2
(45) Date of Patent: Nov. 3, 2026

(54) KEEP-OUT SYSTEMS, METHODS, AND CONTROLLERS FOR A SURFACE-ENGAGING IMPLEMENT OF A MOBILE MACHINE

(71) Applicant: Caterpillar Inc., Peoria, IL (US)

(72) Inventors: Christopher M. Gerth, Chillicothe, IL (US); Bradley P. Krone, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 356 days.

(21) Appl. No.: 18/539,772

(22) Filed: Dec. 14, 2023

(65) Prior Publication Data

US 2025/0198129 A1 Jun. 19, 2025

(51) Int. Cl.

| | |
|---|---|
| ***E02F 9/26*** | (2006.01) |
| ***E02F 5/32*** | (2006.01) |
| *E02F 3/76* | (2006.01) |

(52) U.S. Cl.

CPC ..... *E02F 9/262* (2013.01); *E02F 5/32* (2013.01); *E02F 3/7604* (2013.01)

(58) Field of Classification Search

None

See application file for complete search history.

(56) References Cited

U.S. PATENT DOCUMENTS

| | | | |
|---|---|---|---|
| 4,031,964 | A | 6/1977 | Takahashi et al. |
| 4,062,539 | A | 12/1977 | Tetsuka et al. |
| 5,293,944 | A | 3/1994 | Matsumoto |
| 5,685,377 | A | 11/1997 | Artstein et al. |
| 6,317,676 | B1 | 11/2001 | Gengler et al. |
| 8,083,004 | B2 | 12/2011 | Knight, Jr. |
| 8,616,297 | B2 | 12/2013 | Shintani et al. |

(Continued)

FOREIGN PATENT DOCUMENTS

| | | | |
|---|---|---|---|
| CN | 105002943 | A | 10/2015 |
| CN | 109797793 | B | 7/2021 |

(Continued)

OTHER PUBLICATIONS

U.S. Appl. No. 18/392,915, filed Dec. 21, 2023.

(Continued)

*Primary Examiner* — Jonathan M Dager

(57) ABSTRACT

A mobile machine for operation at a work site having a work surface includes: a frame; a traction device mounted to the frame for moving the mobile machine with respect to the work surface; a surface-engaging implement mounted to the frame, the surface-engaging implement being raisable and lowerable with respect to the frame; a first sensor for providing a machine speed of the mobile machine; a second sensor for providing a machine location of the mobile machine; and a controller storing a three-dimensional site plan associated with the work site that includes at least one keep-out zone. The controller receives the machine speed and the machine location, and, based on the machine speed and the machine location with respect to the at least one keep-out zone, raises the surface-engaging implement and maintains the machine speed; or raises the surface-engaging implement and reduces the machine speed.

20 Claims, 6 Drawing Sheets

(56) References Cited

U.S. PATENT DOCUMENTS 8,620,535 B2 * 12/2013 Friend ..... E02F 9/205 701/50
8,788,157 B2 7/2014 Shintani et al.
9,033,062 B2 5/2015 Stratton et al.
9,292,813 B2 3/2016 Tucker et al.
9,435,102 B2 9/2016 Hall
9,624,650 B2 * 4/2017 Stratton ..... E02F 3/842
10,066,367 B1 * 9/2018 Wang ..... E02F 9/262
10,101,723 B2 * 10/2018 Wei ..... E01C 19/004
10,246,087 B2 4/2019 Mitchell et al.
10,407,872 B2 * 9/2019 Wei ..... E02F 3/7604
10,480,157 B2 * 11/2019 Friend ..... E02F 9/2054
10,518,637 B2 12/2019 Uemura et al.
10,801,177 B2 * 10/2020 Ready-Campbell ..... E02F 3/32
10,907,325 B2 * 2/2021 Ishibashi ..... E02F 9/262
11,041,289 B2 * 6/2021 Ishibashi ..... E02F 9/262
11,174,619 B2 * 11/2021 Ishibashi ..... E02F 9/2037
11,215,781 B1 1/2022 Pino, Jr.
11,492,777 B2 * 11/2022 Kurokawa ..... E02F 9/265
11,549,235 B2 * 1/2023 Wei ..... E02F 3/841
12,442,158 B1 * 10/2025 Sadilek ..... E02F 9/26
12,487,596 B1 * 12/2025 Sadilek ..... E02F 9/205
2002/0162668 A1 * 11/2002 Carlson ..... E02F 9/26 172/1
2007/0299590 A1 * 12/2007 Shull ..... E02F 3/844 701/50
2009/0043462 A1 * 2/2009 Stratton ..... E02F 9/26 701/50
2009/0202109 A1 * 8/2009 Clar ..... E02F 9/261 382/104
2010/0299031 A1 * 11/2010 Zhdanov ..... E02F 3/845 701/50
2012/0073843 A1 3/2012 Kure
2012/0089293 A1 * 4/2012 Halder ..... B60W 50/038 701/24
2012/0136508 A1 * 5/2012 Taylor ..... E02F 9/2045 701/25
2012/0318541 A1 12/2012 Sulzer
2013/0006484 A1 * 1/2013 Avitzur ..... E02F 9/205 701/50
2014/0012404 A1 * 1/2014 Taylor ..... G06F 30/13 700/97
2014/0032058 A1 * 1/2014 Stratton ..... E02F 9/261 701/50
2014/0032132 A1 * 1/2014 Stratton ..... E02F 9/2029 702/33
2014/0174770 A1 * 6/2014 Wei ..... E02F 3/841 701/27
2014/0180548 A1 * 6/2014 Edara ..... E02F 9/261 701/50
2016/0040388 A1 * 2/2016 Kontz ..... E02F 9/2045 701/50
2016/0040392 A1 * 2/2016 Kontz ..... E02F 3/84 700/275
2016/0076222 A1 * 3/2016 Taylor ..... E01C 19/004 701/50
2016/0076223 A1 * 3/2016 Wei ..... E02F 3/43 701/50
2016/0343095 A1 * 11/2016 Wei ..... G06Q 10/06398
2017/0030052 A1 * 2/2017 Wei ..... E02F 3/841
2017/0204588 A1 * 7/2017 Faivre ..... E02F 9/2029
2018/0038068 A1 * 2/2018 Hashimoto ..... E02F 3/847
2018/0038070 A1 * 2/2018 Hashimoto ..... E02F 3/847
2018/0038082 A1 * 2/2018 Hashimoto ..... E02F 3/76
2018/0044888 A1 * 2/2018 Chi ..... G06F 16/2455
2019/0217857 A1 * 7/2019 Sorin ..... B60W 60/0027
2019/0218745 A1 * 7/2019 Hashimoto ..... E02F 3/43
2020/0103906 A1 * 4/2020 O'Donnell ..... E01C 19/004
2020/0117201 A1 * 4/2020 Oetken ..... G05D 1/0044
2020/0149248 A1 * 5/2020 Ram-On ..... E01C 19/004
2020/0332479 A1 * 10/2020 O'Donnell ..... E01C 19/48
2020/0409377 A1 * 12/2020 Ready-Campbell ... G01C 21/20
2021/0097462 A1 * 4/2021 Brickner ..... E02F 9/205
2022/0316173 A1 10/2022 Narikawa et al.
2024/0093464 A1 * 3/2024 Sadilek ..... E02F 9/205
2024/0147888 A1 * 5/2024 Kakkar ..... A01B 69/004
2025/0163671 A1 * 5/2025 Hurwitz ..... G01S 17/89
2025/0207356 A1 * 6/2025 Krone ..... E02F 3/7604

FOREIGN PATENT DOCUMENTS

CN 107313475 B 2/2023
JP 2013-217057 A 10/2013
KR 20150061822 A 6/2015
KR 102252607 B1 5/2021
WO WO 2022/239296 A1 11/2022

OTHER PUBLICATIONS

U.S. Appl. No. 18/394,268, filed Dec. 22, 2023.
U.S. Appl. No. 18/394,295, filed Dec. 22, 2023.
U.S. Appl. No. 18/545,653, filed Dec. 19, 2023.

* cited by examiner

KEEP-OUT SYSTEMS, METHODS, AND CONTROLLERS FOR A SURFACE-ENGAGING IMPLEMENT OF A MOBILE MACHINE

FIELD

The present disclosure generally relates to systems, methods, and controllers to assist a surface-engaging implement, such as a ripper, mounted on a mobile machine, such as a bulldozer, in avoiding keep-out zones, which may include obstructions disposed in and/or under a work surface on which the mobile machine is operating or a soil type that does not need to be treated.

BACKGROUND

Mobile machines, such as, for example, bulldozers, agricultural tractors, and scrapers, often include one or more surface-engaging implements for cultivating, digging, ripping, or otherwise disturbing a work surface, such as a ripper.

FIGS. 1-2 are a schematic views of an exemplary mobile machine 10. Mobile machine 10 may include any mobile machine that performs some type of operation associated with an industry, such as, for example, mining, construction, farming, or any other industry known in the art. For example, mobile machine 10 may be an earth-moving mobile machine such as a bulldozer, a loader, a backhoe, an excavator, a motor grader, or any other earth-moving machine. Mobile machine 10 may traverse a work site to manipulate material beneath a work surface 12, e.g., transport, cultivate, dig, rip, and/or perform any other operation known in the art. Mobile machine 10 may include a power source 14 configured to produce mechanical power, a traction device 16, at least one surface-engaging implement, such as ripper 18, and an operator station 20 to house operator controls. Mobile machine 10 includes a frame 22 for supporting one or more components of mobile machine 10 (e.g., power source 14, traction device 16, ripper 18, etc.).

Power source 14 may be any type of internal combustion engine such as, for example, a diesel engine, a gasoline engine, or a gaseous fuel-powered engine. Power source 14 may instead be a non-engine type of power producing device such as, for example, a fuel cell, a battery, a motor, or another type of power source known in the art. Power source 14 may produce a variable power output directed to ripper 18 and traction device 16 in response to one or more inputs.

Traction device 16 may include tracks located on each side of mobile machine 10 (of which only one side shown in FIGS. 1-2) and operatively driven by one or more sprockets 24. Sprockets 24 may be operatively connected to power source 14 to receive power therefrom and drive traction device 16. Movement of traction device 16 may propel mobile machine 10 with respect to work surface 12. It is contemplated that traction device 16 may additionally or alternately include wheels, belts, or other traction devices, which may or may not be steerable. It is also contemplated that traction device 16 may be hydraulically actuated, mechanically actuated, electronically actuated, or actuated in any other suitable manner.

The surface-engaging implement, such as ripper 18, can be mounted directly on frame 22 or mounted on a frame arm 23, which in turn is connected to frame 22. In either case, however, ripper 18 is rotatable (i.e., about frame 22 or frame arm 23). Ripper 18 may be configured to lift, lower, and tilt relative to frame 22. For example, ripper 18 may include a work tool, such as a shank 26, held in place by a mounting member 27. Shank 26 may penetrate work surface 12 to disturb or disrupt (i.e., rip) the material below work surface 12, and may move relative to mounting member 27. More specifically, shank 26 may have several configurations relative to mounting member 27. For example, shank 26 may be moved higher, lower, away from, and toward frame 22. Mounting member 27 may be connected to frame 22 via a linkage system with at least one implement actuator forming a member in the linkage system, and/or in any other suitable manner. For example, a first hydraulic actuator 28 may be connected to lift and lower ripper 18, and a second hydraulic actuator 30 may be connected to tilt ripper 18. It is contemplated that surface-engaging implement 18 may alternatively include a plow, a tine, a cultivator, and/or any other task-performing work tool known in the art, rather than shank 26.

The movement of ripper 18 may correspond to a plurality of predetermined locations and/or orientations. For example, ripper 18 may have a work tool angle $\alpha$ and a frame arm angle $\beta$, as shown in FIGS. 1-2, that can be varied based on a material composition of work surface 12, a size or capacity of mobile machine 10, the configuration of shank 26 relative to mounting member 27, and/or one or more inputs of an operator. In one example, work tool angle $\alpha$ of shank 26 may correspond to shank 26 being substantially vertical relative to work surface 12 for efficient penetration of work surface 12 (for example, work tool angle $\alpha$ could be approximately 30°, as shown in FIG. 1, to have shank 26 be vertical with respect to work surface 12). In order to maintain such a work tool angle $\alpha$ for each of the available shank configurations, the implement actuators of mounting member 27 may need to be adjusted based on the current shank configuration. Frame arm angle $\beta$ of frame arm 23 may correspond to a forward tilt of shank 26 to facilitate efficient digging, while keeping shank 26 from digging under mobile machine 10 and forcing material against an underbelly of mobile machine 10. In order to maintain shank 26 at the correct digging position relative to the underbelly of mobile machine 10, the implement actuators of mounting member 27 may need to be adjusted based on the current shank configuration.

In an exemplary digging operation, an operator of mobile machine 10 may set the configuration of shank 26. For example, the operator may manually loosen bolts fastening shank 26 to mounting member 27 in a first configuration, move shank 26 to a discrete location on mounting member 27, and tighten the bolts to retain shank 26 in place. In another example, shank 26 may be movable by a motor, pulley system, or a hydraulic actuator to mechanically slide from the first configuration to the second configuration. It is contemplated that this sliding mechanism may be controlled electrically or mechanically by the operator and/or a controller. That is, the operator may set the configuration of shank 26 by manipulating a switch, a joystick, a button, or any other interface known in the art.

The operator may then control the implement actuators of mounting member 27 to set shank 26 to a dig angle $\theta$ associated with the current configuration of shank 26 with respect to work surface 12. That is, the operator may control the implement actuators of mounting member 27 to orient shank 26 relative to work surface 12 prior to penetration. The operator may then control the implement actuators to lower shank 26 and penetrate work surface 12. Once shank 26 has penetrated work surface 12, the operator may control the implement actuators of mounting member 27 to vary dig angle $\theta$ for the current configuration of shank 26. That is, the operator may control the implement actuators to set shank 26 to a dig angle θ, work tool angle α, and/or frame arm angle β that does not place shank 26 under mobile machine 10, yet facilitates efficient digging. It is contemplated that all or some of the above-described digging process may be managed automatically.

Hydraulic actuators 28, 30 may each include a piston-cylinder arrangement, a hydraulic motor, and/or another known hydraulic device having one or more fluid chambers therein. In a piston-cylinder arrangement, pressurized fluid may be selectively supplied to and drained from one or more chambers thereof to affect linear movement of the actuator, as is known in the art. In a hydraulic motor arrangement, pressurized fluid may be selectively supplied to and drained from chambers on either side of an impeller to affect rotary motion of hydraulic actuators 28, 30. The movement of hydraulic actuator 28 may assist in moving ripper 18 with respect to frame 22 and work surface 12, particularly down toward and up away from work surface 12. It is contemplated that an extension of hydraulic actuator 28 may correlate to a position of ripper 18 with respect to work surface 12. Similarly, the movement of hydraulic actuator 30 may assist in orienting ripper 18 with respect to frame 22 and work surface 12, particularly decreasing or increasing dig angle θ and/or work tool angle α. It is contemplated that an extension of hydraulic actuator 30 may correlate to an orientation of ripper 18 with respect to work surface 12.

Operator station 20 may provide a control interface for an operator of mobile machine 10. For example, operator station 20 may include a deceleration pedal 32 and a ripper control 34. Although not shown, it is contemplated that operator station 20 may additionally include other controls such as, for example, a machine direction control, an acceleration pedal, or any other control device known in the art.

Ripper control 34 may allow an operator of mobile machine 10 to manipulate ripper 18. More specifically, ripper control 34 may control an amount or a pressure of fluid supplied to and drained from hydraulic actuators 28, 30. Thus, ripper control 34 may allow the operator to set a work tool height H of shank 26, as shown in FIG. 2, above or below work surface 12. For example, work tool height H could be positive if shank 26 is positioned above work surface 12, negative if shank 26 is positioned below work surface 12, or zero if positioned on work surface 12. Ripper control 34 also allows the operator to set work tool angle α, frame arm angle β, and dig angle θ. Ripper control 34 may allow the operator to move shank 26 from a position above work surface 12 down to penetrate work surface 12, and to set a depth of cut below work surface 12 (i.e., a negative work tool height H) so that shank 26 may disturb or disrupt the material below work surface 12 during a ripping operation. Ripper control 34 may also allow the operator to change work tool angle α, frame arm angle β, and dig angle θ while shank 26 is above or below work surface 12. For example, the operator may manipulate ripper control 34 to set shank 26 to a dig angle θ before lowering shank 26 to penetrate work surface 12. The operator may further manipulate ripper control 34 to set shank 26 to an optimal dig angle θ once shank 26 has penetrated work surface 12 to a desired depth (i.e., work tool height H). Ripper control 34 may embody, for example, a joystick. It is contemplated that ripper control 34 may embody any other appropriate control apparatus known in the art, and that ripper control 34 may alternatively embody separate control apparatuses for determining work tool angle α, frame arm angle β, dig angle θ, and work tool height H, respectively.

FIG. 3 illustrates control system 38 having components that cooperate to move ripper 18. For example, control system 38 may include a user interface 39, a first sensor 40 to measure machine speed V, a second sensor 42 to measure a machine location L of mobile machine 10, a third sensor 44 to monitor the positions of hydraulic actuators 28, 30, and a controller 46. User interface 39 may allow an operator to input values relevant to operation of mobile machine 10, such as, for example, an operation of shank 26 and a desired dig angle θ of shank 26. It is contemplated that optimal work tool angle α, frame arm angle β, dig angle θ, and work tool height H values may be predetermined or calculated automatically by controller 46 based on, for example, the configuration of shank 26 relative to mounting member 27.

Sensors 40, 42, 44 may each include conventional hardware to establish a signal as a function of a sensed physical parameter. Sensor 40 may be located to sense machine speed V of mobile machine 10 with respect to work surface 12. For example, sensor 40 may be disposed adjacent work surface 12, and may generate a signal indicative of machine speed V of mobile machine 10 relative to work surface 12. Sensor 40 may embody any type of motion or speed-sensing sensor, such as, for example, a global positioning sensor, an infrared sensor, a Hall sensor, a rotation sensor, or a radar sensor. For example, sensor 40 may be sensitive to variations in a given magnetic field generated by sensor 40 or by another component near sensor 40. As sprockets 24 rotate to drive traction device 16, magnetic elements embedded within sprockets 24 may cause a variation in a magnetic field. Sensor 40 may then use the frequency of the variations to calculate a speed of the driven component. Sensor 40 could instead be coupled to a transmission of mobile machine 10 to calculate mobile machine 10's machine speed from, if so equipped, an engine RPM and transmission gear ratio of power source 14 or traction device 16. Alternatively, sensor 40 may transmit a radio signal with a given wavelength and frequency toward work surface 12. The radio signal may bounce off of work surface 12 back to sensor 40 with a changed wavelength and/or frequency according to the Doppler effect. Sensor 40 may then use the difference between the original wavelength and frequency and the changed wavelength and frequency to calculate the speed of mobile machine 10. It is contemplated that sensor 40 may include a plurality of sensors establishing a plurality of signals, and that the plurality of signals may be combinable into a common signal, if desired.

Sensor 42 may sense a machine location L of mobile machine 10 either globally and/or with respect to work surface 12. Sensor 42 may embody any type of location-sensing sensor, such as, for example, a satellite positioning unit of a global navigation satellite system, or GNSS. A GNSS is a satellite navigation system with global coverage that can be used to provide geo-positioning of objects associated with the GNSS, such as mobile machine 10. One example of a GNSS is a global positioning system, or GPS. Sensor 42 may be embodied as a satellite positioning unit disposed on mobile machine 10. The satellite positioning unit generates signals indicative of machine location L of mobile machine 10. The satellite positioning unit may determine and generate signals corresponding to the latitude and/or longitude of mobile machine 10. The satellite positioning unit may be disposed on a top portion of mobile machine 10 to communicate with a number of satellites of the GNSS and to receive signals indicative of machine location L of mobile machine 10. It is contemplated that sensor 42 may include a plurality of sensors establishing a plurality of signals, and that the plurality of signals may be combinable into a common signal, if desired.

Sensor 44 may sense an extension of one or more chambers of hydraulic actuators 28, 30. As indicated in FIG. 3, sensor 44 may embody, for example, two individual sensors 44*a*, 44*b*, one associated with each of hydraulic actuator 28 and hydraulic actuator 30, respectively. Sensor 44*a* may be disposed adjacent to and/or within hydraulic actuator 28 to generate a signal indicative of an extension of hydraulic actuator 28. It is contemplated that the signal generated by sensor 44*a* may represent values proportional to at least one of work tool angle α, frame arm angle β, dig angle θ, and work tool height H. It is also contemplated that sensor 44*a* may embody any type of sensor known in the art, such as, for example, a position sensor. That is, sensor 44*a* may generate a signal indicative of a length distance within a chamber of hydraulic actuator 28. It is contemplated that sensor 44*a* may selectively include a plurality of sensors each establishing a plurality of signals, and that the plurality of signals may be combinable into a common signal.

Sensor 44*b* may operate similarly to sensor 44*a*. More specifically, sensor 44*b* may be disposed adjacent to and/or within hydraulic actuator 30 to generate a signal indicative of an extension of hydraulic actuator 30. It is contemplated that the signal generated by sensor 44*b* may represent values proportional to at least one of work tool angle α, frame arm angle β, dig angle θ, and work tool height H. It is also contemplated that sensor 44*b* may embody any type of sensor known in the art, such as, for example, a position sensor. That is, sensor 44*b* may generate a signal indicative of a length distance within a chamber of hydraulic actuator 30. It is contemplated that sensor 44*b* may selectively include a plurality of sensors each establishing a plurality of signals, and that the plurality of signals may be combinable into a common signal.

Mobile machine 10 may include one or more inertial motion units, or IMUs 45. An IMU is a measuring device that itself may include a number of sensors. The sensors may include accelerometers and/or gyroscopes. The sensors may generate signals indicative of various positional attributes of the object to which it is attached, such as a change in the velocity of object, a change in the attitude/orientation of the object, and a change in the path of travel of the object. The IMU determines the acceleration of the object based on the signals generated by the sensors of the IMU. For example, mobile machine 10 may include a first IMU 45*a* mounted on frame 22 and a second IMU 45*b* mounted on ripper 18. Optionally, a third IMU 45*c* could be mounted on frame arm 23. GNSS and its satellite positioning unit (e.g., sensor 42) can be used to correct any bias in the output provided by IMUs 45*a*, 45*b*, 45*c* in order to obtain more accurate readings and therefore enable more precise control of mobile machine 10 and ripper 18.

Controller 46 may receive the signals generated by sensors 40, 42, 44 to assist in controlling operation of mobile machine 10. That is, controller 46 may be communicatively coupled with sensors 40, 42, 44, deceleration pedal 32, ripper control 34, hydraulic actuators 28, 30, user interface 39, and any other component of mobile machine 10 that may be used in controlling operation of mobile machine 10.

Controller 46 may embody a single microprocessor or multiple microprocessors that include a means for controlling mobile machine 10. For example, controller 46 may include a memory, a secondary storage device, and a processor, such as a central processing unit or any other means for controlling mobile machine 10. Numerous commercially available microprocessors can be configured to perform the functions of controller 46. It should be appreciated that controller 46 could embody a general power source microprocessor capable of controlling numerous power source functions. Various other known circuits may be associated with controller 46, including power supply circuitry, signal-conditioning circuitry, solenoid driver circuitry, communication circuitry, and other appropriate circuitry. It should also be appreciated that controller 46 may include one or more of an application-specific integrated circuit (ASIC), a field-programmable gate array (FPGA), a computer system, and a logic circuit, configured to allow controller 46 to function. Thus, the memory of controller 46 may embody, for example, the flash memory of an ASIC, flip-flops in an FPGA, the random access memory of a computer system, or a memory circuit contained in a logic circuit. Controller 46 may be further communicatively coupled with an external computer system, instead of or in addition to including a computer system.

Controller 46 may control the movement of ripper 18. To that end, controller 46 may receive input signals from an operator of mobile machine 10, monitor signals generated by sensors 40, 42, 44, perform one or more algorithms to determine appropriate output signals, and deliver the output signals to one or more components of mobile machine 10 to control work tool angle α, frame arm angle β, dig angle θ, and work tool height H. For example, controller 46 may store a plurality of values representing the possible work tool angle α, frame arm angle β, dig angle θ, and work tool height H values in its memory, each value being mapped to corresponding configurations and/or operations of shank 26. Controller 46 may cause shank 26 to move to one of those values based on the current configuration and/or operation of shank 26. More specifically, controller 46 may monitor the signals generated by sensors 44*a*, 44*b* for the extension of hydraulic actuators 28, 30, convert those signals to a value of work tool angle «, frame arm angle β, dig angle θ, and/or work tool height H they represent, and compare them to one or more values stored in the memory of controller 46. Controller 46 may then drive hydraulic actuators 28, 30 to move shank 26 until the values indicated by the signal from sensors 44*a*, 44*b* substantially equal the values stored in the memory of controller 46.

Controller 46 may set the depth of cut of shank 26 (i.e., work tool height H) in a similar manner. More specifically, controller 46 may monitor the signal generated by sensor 44*a* for the extension of hydraulic actuator 28, convert it to value representing the possible work tool heights H it represents, and compare it to one or more values stored in the memory of controller 46, driving hydraulic actuator 28 until the two values are substantially equal. Controller 46 may drive hydraulic actuators 28, 30 by controlling one or more valves and/or other components of an associated hydraulic system, e.g., pumps, to selectively supply pressurized fluid to and drain the fluid from hydraulic actuators 28, 30.

Controller 46 may also control the acceleration and deceleration of traction device 16. That is, controller 46 may be communicatively connected to power source 14 to affect the operation of power source 14 by increasing or reducing an amount of fuel delivered to power source 14, changing a timing of fuel injections into power source 14, increasing or reducing an amount of air delivered to power source 14, and/or increasing or reducing an amount of electrical power output by power source 14. It is contemplated that controller 46 may alternatively control the acceleration and deceleration of traction device by directly manipulating the position of deceleration pedal 32, if desired.

In this configuration, mobile machine 10 and ripper 18 are operable together to loosen and stir material of work surface 12 before completion of bulk earth-moving or other tasks. However, work surface 12 is commonly at a construction site or a mine site. As such, work surface 12 often includes obstructions in work surface 12 itself and/or under work surface 12 that could potentially come into contact with ripper 18 during its operation, resulting in various undesirable situations. For example, if shank 26 of ripper comes 18 into contact with a buried utility (e.g., electrical, water, gas, telecommunications, etc.) line, ripper 18 could unintentionally sever or unearth the utility line. Ripper 18 could also come into contact with a large object, such as a buried boulder, that could damage ripper 18 and/or mobile machine 10. As such, an operator of mobile machine 10 must exercise caution when in proximity to such obstructions so as to avoid contacting them with shank 26 of ripper 18. It is also contemplated that a portion of work surface 12 may include a soil type that does not need to be treated by ripper 18.

SUMMARY

One aspect of the present disclosure is directed to a mobile machine for operation at a work site having a work surface, the mobile machine comprising: a frame; a traction device mounted to the frame, the traction device being configured to move the mobile machine with respect to the work surface; a surface-engaging implement mounted to the frame, the surface-engaging implement being raisable and lowerable with respect to the frame; a first sensor configured to provide a machine speed of the mobile machine; a second sensor configured to provide a machine location of the mobile machine; and a controller storing a three-dimensional site plan associated with the work site, the three-dimensional site plan including at least one keep-out zone, the controller being configured to receive the machine speed and the machine location, and, based on the machine speed and the machine location with respect to the at least one keep-out zone, to at least one of: raise the surface-engaging implement and maintain the machine speed, raise the surface-engaging implement and reduce the machine speed, stop the mobile machine, or provide an indication to an operator of the mobile machine.

Another aspect of the present disclosure is directed to a method for operating a mobile machine at a work site having a work surface, the mobile machine including a surface-engaging implement for engaging the work surface, the surface-engaging implement being raisable and lowerable with respect to the mobile machine, the method comprising: storing a three-dimensional site plan associated with the work site in a controller of the mobile machine, the three-dimensional site plan including at least one keep-out zone, receiving, by the controller, a machine speed of the mobile machine; receiving, by the controller, a machine location of the mobile machine; evaluating, by the controller, the machine speed and the machine location with respect to the at least one keep-out zone, and in response, at least one of: raise the surface-engaging implement and maintain the machine speed, raise the surface-engaging implement and reduce the machine speed, stop the mobile machine, or provide an indication to an operator of the mobile machine.

A further aspect of the present disclosure is directed to a controller for a mobile machine having a surface-engaging implement raisable and lowerable with respect to the mobile machine, the controller being configured to: store a three-dimensional site plan associated with a work site at which the mobile machine is operable, the three-dimensional site plan including at least one keep-out zone; receive a machine speed of the mobile machine; receive a machine location of the mobile machine; and evaluate the machine speed and the machine location with respect to the at least one keep-out zone, and in response: raise the surface-engaging implement and maintain the machine speed, raise the surface-engaging implement and reduce the machine speed, stop the mobile machine, or provide an indication to an operator of the mobile machine.

DETAILED DESCRIPTION

The present application describes systems, methods, and controllers that allow a mobile machine, such as a bulldozer, that includes a surface-engaging implement, such as a ripper, to automatically avoid contact between the surface-engaging implement and obstructions in one or more keep-out zones associated with a work site at which the mobile machine is operable. The one or more keep-out zones are features of a three-dimensional site plan associated with the work site. The mobile machine then uses the three-dimensional site plan along with other information associated with operation of the mobile machine, such as machine speed and machine location, for example, to determine how to automatically control the surface-engaging implement and/or the mobile machine. By controlling the surface-engaging implement and/or the mobile machine in this manner, the systems, methods, and controllers of the present application minimize the risk of the surface-engaging implement coming into contact with various obstructions throughout the work site.

Common examples of such obstructions include buried utility lines. By automatically controlling the mobile machine to, for example, raise the surface-engaging implement upon approaching such obstructions or even stop the mobile machine entirely, the systems, methods, and controllers of the present application allow the operator to focus on other tasks associated with operation of the mobile machine at the work site, improving efficiency.

In addition to including information about obstructions at the work site, such as buried utility lines or large boulders, and the formation of various keep-out zones around those obstructions, the three-dimensional site plan can include other relevant information relating to the work site and operation of the mobile machine at the work site. For example, the site plan can include topography and elevation data, indications of soil type, types of operations the mobile machine is intended to carry out at specific locations or sectors within the site plan, etc. As one example, the three-dimensional site plan may indicate that a certain portion of the work site comprises a soil type that does not need to be treated by the surface-engaging implement of the mobile machine (e.g., not ripped). That portion of the work site can then me marked on the three-dimensional site plan as a keep-out zone, decreasing the likelihood that the mobile machine and its surface-engaging implement will do unnecessary work in that area.

Figure 1:
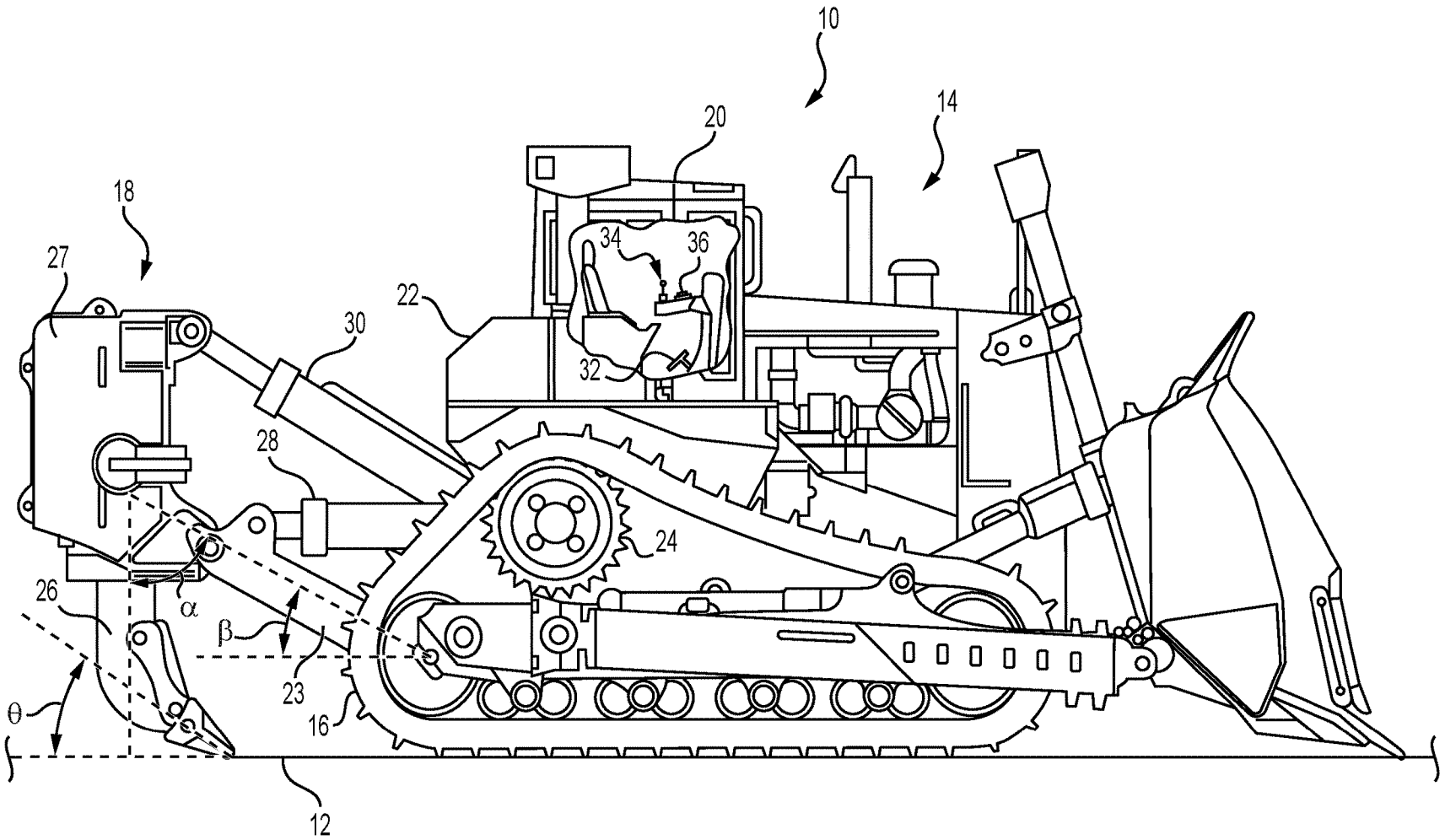
FIG. 1 (PRIOR ART)
FIG. 1 is a side view of a conventional bulldozer, which is an example of a mobile machine.
Figure 2:
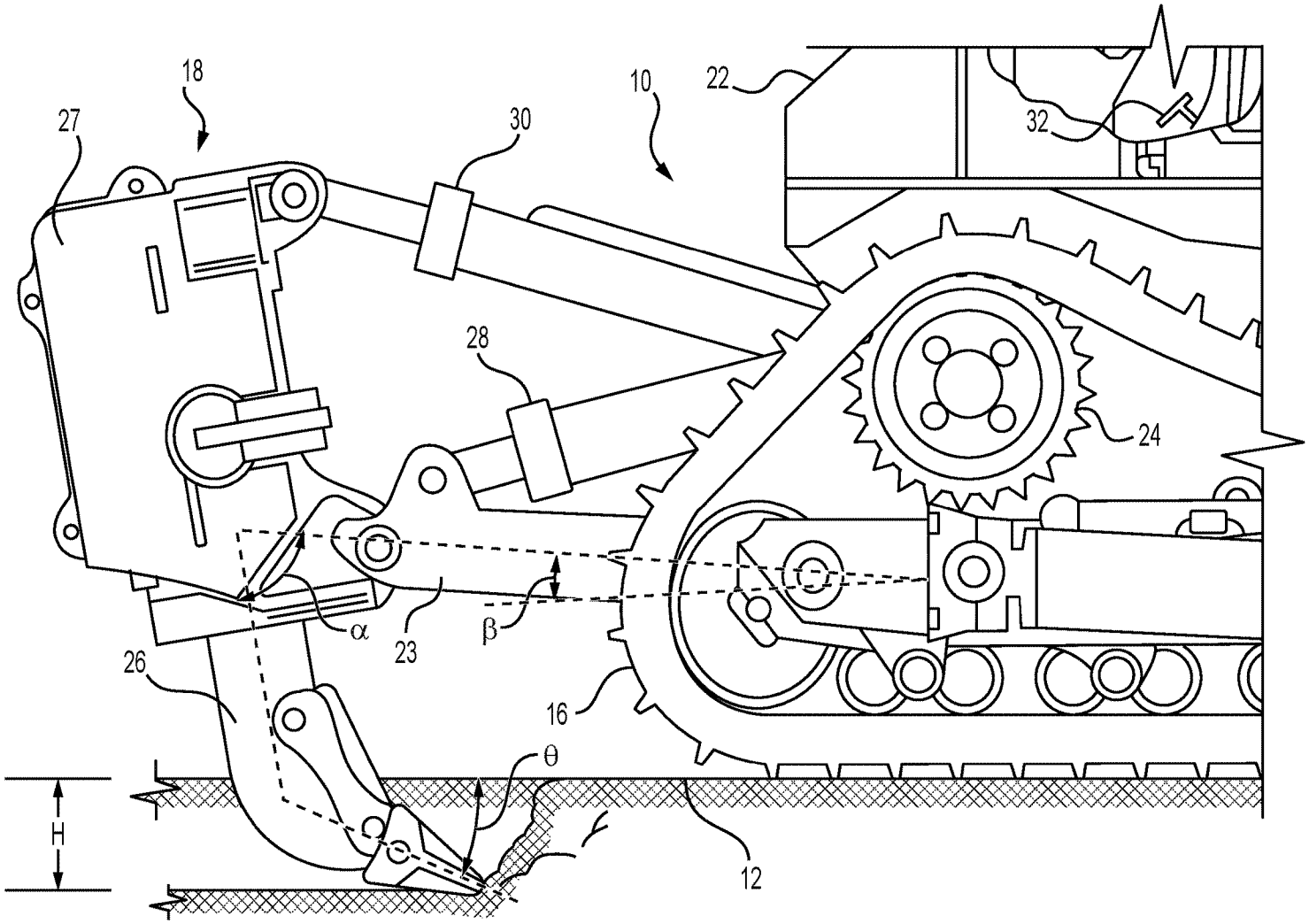
FIG. 2 (PRIOR ART)
FIG. 2 is a detailed view of the bulldozer of FIG. 1 showing a ripper mounted to the bulldozer.
Figure 3:
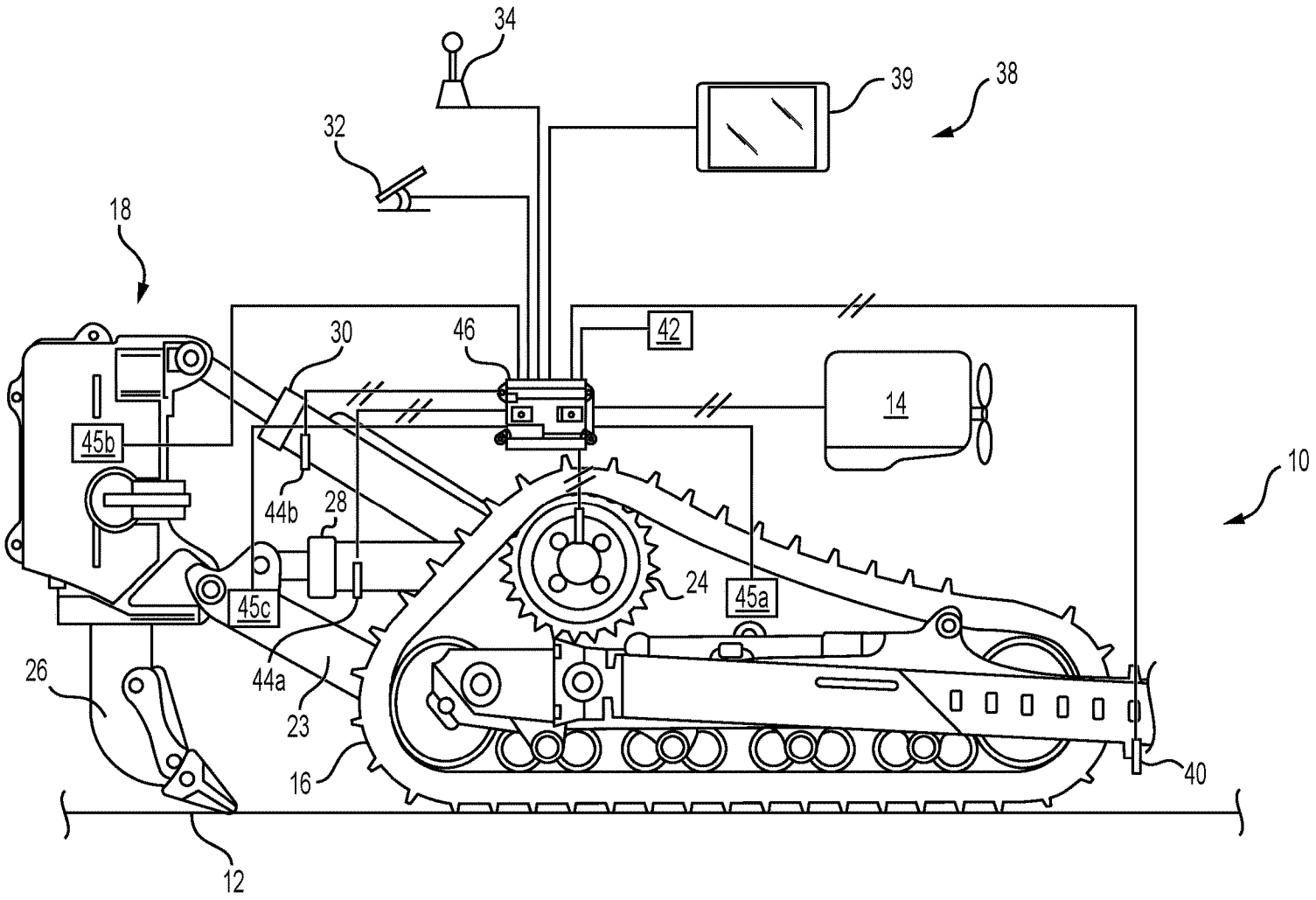
FIG. 3 (PRIOR ART)
FIG. 3 shows various components of a control system of the bulldozer of FIG. 1.
Figure 4:
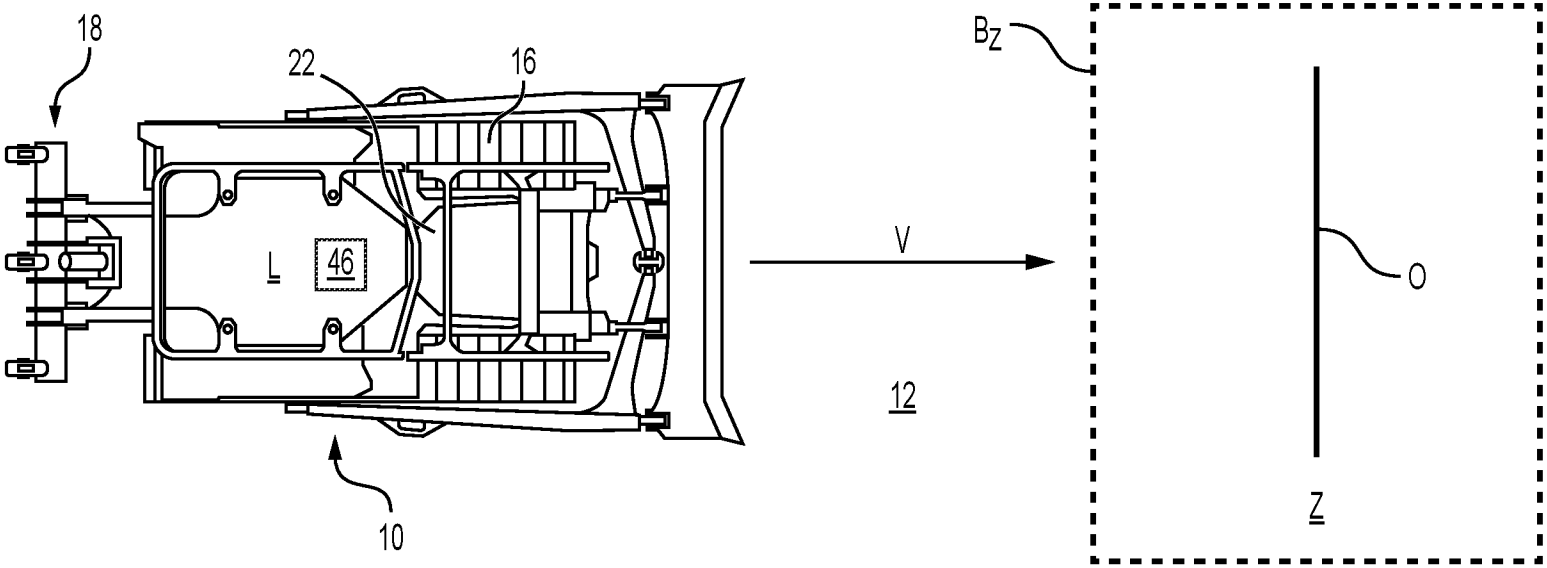
FIG. 4 shows a bulldozer approaching a keep-out zone in accordance with the present disclosure.
Figure 5:
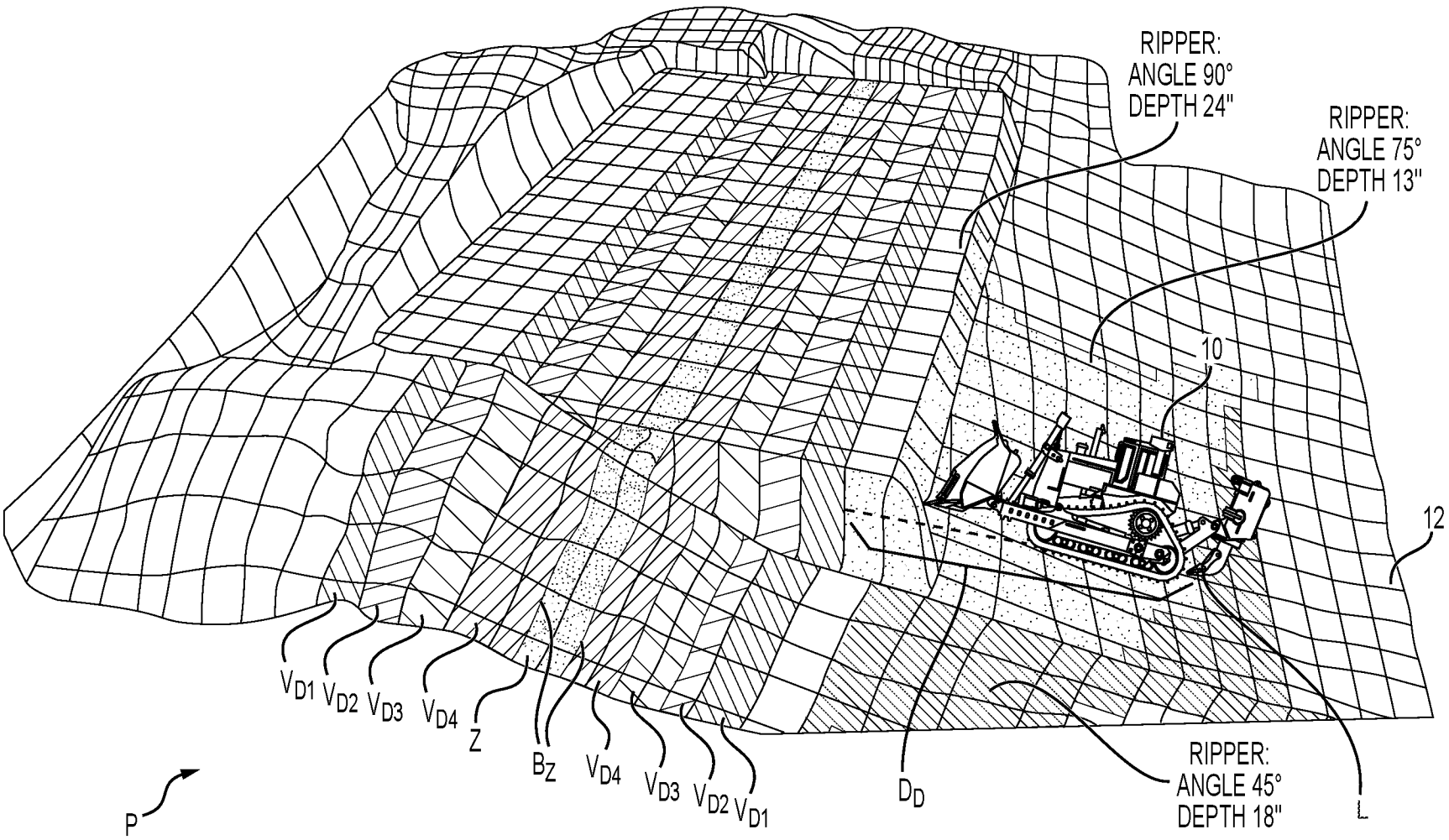
FIG. 5 shows a three-dimensional site plan of a work site in accordance with the present disclosure.

FIGS. 4-5 show a mobile machine 10 similar to that described in connection with FIGS. 1-3, except in the context of FIGS. 4-5 mobile machine 10 is equipped with technology that facilitates the features of the present disclosure. In particular, controller 46 of mobile machine 10 has stored therein (i.e., in the memory thereof) a three-dimensional site plan associated with a work site, such as three-dimensional site plan P shown in FIG. 5. While FIG. 4 depicts controller 46 being physically disposed on mobile machine 10, it is possible that controller 46 be remotely located with respect to mobile machine 10 (e.g., if mobile machine 10 is being operated autonomously from a computer at a control center that is physically distant from the work site), In practice, however, the concepts described herein are equally applicable irrespective of the location of controller 46 (i.e., physically disposed on mobile machine 10 or elsewhere).

Three-dimensional site plan P includes information describing the work site and its work surface 12, including identification of one or more keep-out zones Z. Keep-out zones Z are three-dimensional zones that used to identify the location of one or more obstructions O, such as buried utility lines, large boulders, etc. While three-dimensional site plan P includes more information (e.g., elevation/topographical information, depth below work surface 12 of obstructions O, etc.) given that it is three-dimensional, it is also envisioned that the systems, methods, and controllers of the present application could instead use a two-dimensional site plan (e.g., defining latitude and longitude only, but not elevation/depth information). In practice, however, such a simplification could lead to less effective control of mobile machine 10.

Controller 46 is configured to receive at least a machine speed V of mobile machine 10 and a machine location L of mobile machine 10 as inputs. Machine location L could be a global location, namely one based on: a geographic coordinate system using latitude, longitude, and elevation; an open location code, such as plus codes and the like; geo-hashes; a global area reference system; or similar. Alternatively, machine location L could be related to the specific work site at which mobile machine 10 is operating. Moreover, while any point on mobile machine 10 could be used as machine location L, it is contemplated that more precise control is possible if machine location L corresponds to a location of ripper 18, and particularly to a location of shank 26, as this is the component of mobile machine 10/ripper 18 that is most likely to come into contact with obstruction O during operation of mobile machine 10 or cause issues if it enters keep-out zone Z.

For example, controller 46 could receive machine location L from sensor 42, which could be any type of location-sensing sensor, such as a satellite positioning unit of a GNSS. Alternatively, and/or in addition, controller 46 could determine machine location L based on input from sensor 44, which senses extension of the chambers of hydraulic actuators 28, 30. Specifically, sensors 44*a*, 44*b*, associated with hydraulic actuator 28 and hydraulic actuator 30, respectively, could output values corresponding to their extension, which values in turn correspond to a specific location of either ripper 18 or shank 26. Sensors 44*a*, 44*b* could also be used to provide an indication of one or more of work tool angle α, frame arm angle β, dig angle θ, and work tool height H so as to more precisely determine machine location L. In any case, however, outputs of sensor 44*a*, 44*b* could be used to determine machine location L based on the structural geometry of one or more of frame 22, ripper 18, frame arm 23, hydraulic actuators 28, 30, and shank 26, among other components of mobile machine 10. Using outputs of sensors 44*a*, 44*b* to determine machine location L could provide a more precise indication of the location of shank 26 with respect to three-dimensional site plan P and specifically obstructions O within keep-out zones Z, as compared to relying solely on output from sensor 42.

No matter which sensors are used to determine machine location L, however, any IMUs associated with mobile machine 10, such as IMUs 45*a*, 45*b*, 45*c*, could be used to obtain a more accurate determination of machine location L, whether machine location L corresponds to mobile machine 10 generally, ripper 18, and/or shank 26. Additionally, sensor 42 (i.e., a satellite positioning unit) could be used to further improve the accuracy of the determination of machine location L if machine location L is primarily based on outputs from sensors 44*a*, 44*b*, which are associated with the extension of hydraulic actuators 28, 30, respectively. Moreover, any other location-determination methods or techniques known in the art could be used to determine machine location L.

In addition to receiving machine location L, controller 46 can also receive a machine speed V of mobile machine 10. Machine speed V can be provided in any of the conventional manners discussed above, namely through use of sensor 40 and/or sensor 42.

Based on machine speed V and machine location L with respect to one or more keep-out zones Z identified on three-dimensional site plan P, controller 46 can implement one or more operations. For example, upon receiving machine speed V and machine location L, controller 46 can evaluate three-dimensional site plan P, machine speed V, and machine location L and determine that mobile machine 10 is approaching a keep-out zone boundary $B_Z$ of a particular keep-out zone Z and its associated obstruction O. In response, controller 46 could then, for example, issue an appropriate command to raise the ripper 18 with respect to work surface 12 (e.g., by extending one or both of hydraulic actuators 28, 30). Issuing such a command would cause shank 26 to be raised to either a smaller negative work tool height H, a zero work tool height H, or a positive work tool height H, for example. Varying or increasing one or both of work tool angle α (e.g., by retracting both hydraulic actuators 28, 30) and frame arm angle β (e.g., by retracting hydraulic actuator 30 but keeping hydraulic actuator 28 at the same extension) could also result in shank 26 being raised. By raising shank 26 upon approaching keep-out zone boundary $B_Z$, shank 26 will no longer come into contact with obstruction O, avoiding potential damage to obstruction O and/or ripper 18.

Depending on how close machine location L is to keep-out zone boundary $B_Z$ at the time of raising ripper 18, controller 46 could also issue one or more commands to maintain machine speed V, reduce machine speed V, or stop mobile machine 10 (i.e., bring machine speed V to zero). Controller 46 can affect machine speed V in the typical sense, namely by controlling one or more of power source 14, traction device 16, deceleration pedal 32, applying friction-driven braking force, etc. What controller 46 does in relation with vehicle speed V is correlated with the amount of time mobile machine 10 has to sufficiently raise ripper 18 before ripper 18 traverses keep-out zone boundary $B_Z$, as discussed in more detail below.

Furthermore, in response to determining that mobile machine 10 is in close proximity to keep-out zone boundary $B_Z$, controller 46 could also provide an indication I, such as an audible and/or visual alert, whether on user interface 39 or otherwise. In response, the operator of mobile machine 10 can then take action so as to raise ripper 18 before ripper 18 traverses keep-out zone boundary $B_Z$ and/or to ensure that shank 26 does not come into contact with obstruction O.

In an embodiment, upon receiving machine speed V and machine location L, controller 46 can reference three-dimensional site plan P and determine a distance difference $D_D$ between machine location L and keep-out zone boundary $B_Z$. Distance difference $D_D$ is most clearly shown in FIG. 5. Although shown as being two-dimensional (i.e., a scalar), distance difference $D_D$ could also be three-dimensional (i.e., a vector). Controller 46 then evaluates distance difference $D_D$ and compares distance difference $D_D$ to one or more distance values $V_D$, which themselves could also be scalars or vectors as appropriate. For example, if controller 46 determines that distance difference $D_D$ is less than a first distance value $V_{D1}$, controller 46 knows that mobile machine 10 is approaching keep-out zone Z. Controller 46 can also evaluate machine speed V to determine how quickly mobile machine 10 is approaching keep-out zone Z.

By comparing distance difference $D_D$ to one or more distance values $V_D$, controller 46 can determine an appropriate course of action needed for raising ripper 18 and its shank 26 to an appropriate work tool height H in a timely fashion (e.g., to avoid contact between obstruction O and shank 26). For example, upon determining that distance difference $D_D$ is less than first distance value $V_{D1}$, controller 46 knows mobile machine 10 is within proximity of keep-out zone Z and its keep-out zone boundary $B_Z$. If distance difference $D_D$ is still greater than a second distance value $V_{D2}$, second distance value $V_{D2}$ being less than first distance value $V_{D1}$, then controller 46 knows it has sufficient time to raise ripper 18 without needing to at the same time decrease machine speed V. Controller 46 can then issue one or more commands to raise ripper 18 while maintaining vehicle speed V relatively constant.

If distance difference $D_D$ is greater than a third distance value VDs, third distance value $V_{D3}$ being less than second distance value $V_{D2}$, then controller 46 knows it does not have sufficient time to raise ripper 18 without needing to at the same time decrease machine speed V. Controller 46 can then issue one or more commands to raise ripper 18 while at the same time issue one or more commands to reduce machine speed V.

If distance difference $D_D$ is greater than a fourth distance value VDs, fourth distance value $V_{D4}$ being less than third distance value $V_{D3}$, then controller 46 knows it does not have sufficient time to raise ripper 18 before reaching keep-out zone boundary $B_Z$, no matter whether it at the same time decreases machine speed V. Controller 46 can then issue one or more commands to stop mobile machine 10 (i.e., bring machine speed V to zero).

In sum, the closer that mobile machine 10 comes to keep-out zone boundary $B_Z$, the more evasive action is needed to ensure ripper 18 is raised before ripper 18 traverses keep-out zone boundary $B_Z$ and/or that shank 26 does not come into contact with obstruction O.

Figure 6:
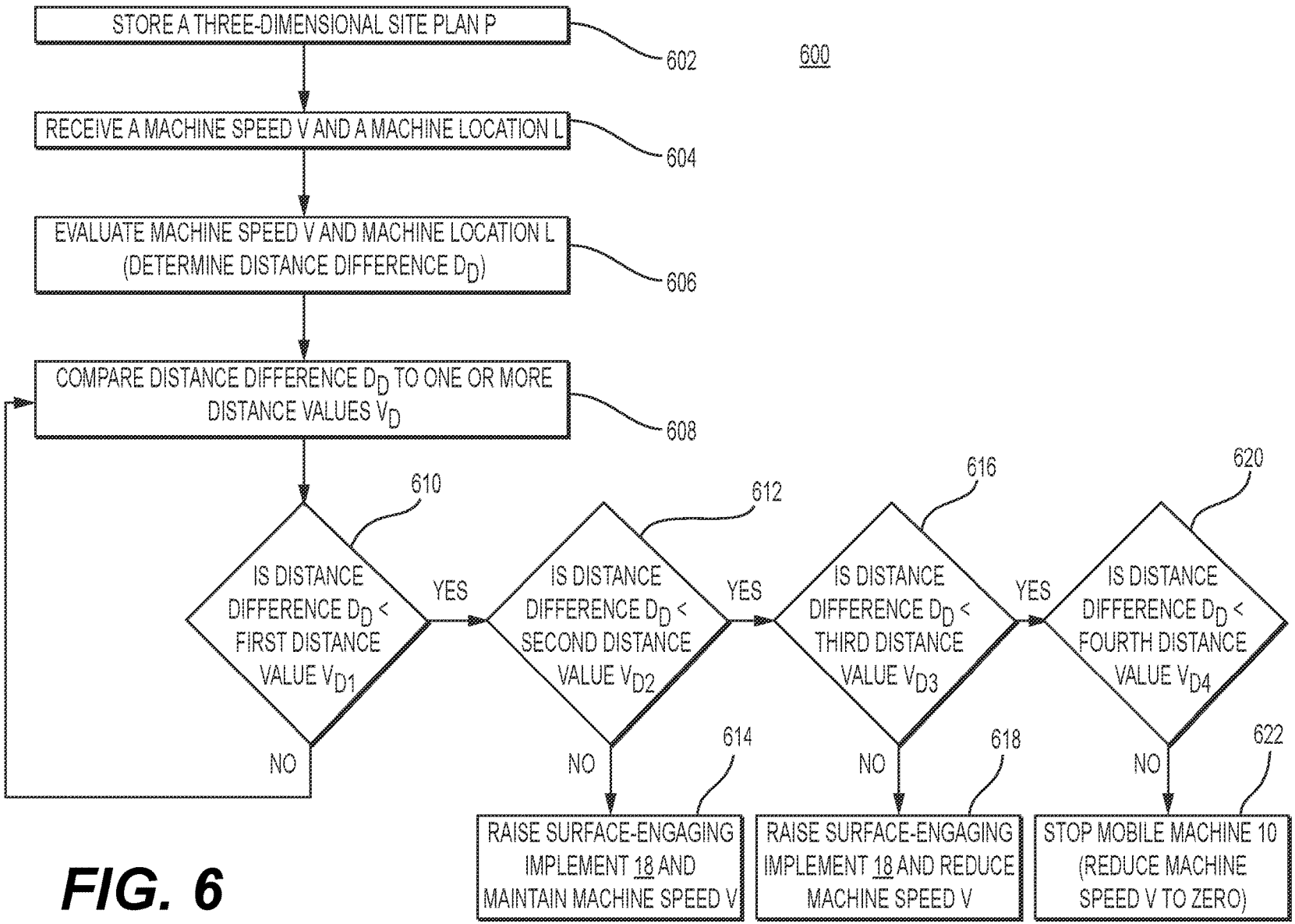
FIG. 6 shows a flowchart of a method for operating a mobile machine according to the present disclosure.

The foregoing discussion is also equally applicable to a method 600 for operating mobile machine 10 at a work site having work surface 12, as demonstrated in FIG. 6. In step 602 of method 600, three-dimensional site plan P associated with the work site is stored in controller 46 of mobile machine 10. Three-dimensional site plan P includes at least one keep-out zone Z. In step 604, controller 46 receives machine speed V and machine location L. In step 606, controller 46 evaluates machine speed V and machine location L with respect to at least one keep-out zone Z. Evaluation of machine location L with respect to at least one keep-out zone Z can include determining distance difference $D_D$ between machine location L and a keep-out zone boundary $B_Z$ of at least one keep-out zone Z.

In step 608, controller 46 compares distance difference $D_D$ to one or more distance values $V_D$ to determine the appropriate course of action to ensure ripper 18 is raised before ripper 18 traverses keep-out zone boundary $B_Z$ and/or that shank 26 does not come into contact with obstruction O. More particularly, in step 610, controller 46 compares distance difference $D_D$ to first distance value $V_{D1}$. If distance difference $D_D$ is greater than first distance value $V_{D1}$, mobile machine 10 is not within proximity of keep-out zone boundary $B_Z$ of at least one keep-out zone Z, and there is no need to raise ripper 18 or slow or stop mobile machine 10. Controller 46 then continues comparing distance difference $D_D$ and first distance value $V_{D1}$.

If in step 610 distance difference $D_D$ is less than first distance value $V_{D1}$, mobile machine 10 is within proximity of keep-out zone boundary $B_Z$ of at least one keep-out zone Z. Method 600 then proceeds to step 612, in which controller 46 compares distance difference $D_D$ to second distance value $V_{D2}$, which is less than first distance value $V_{D1}$. If distance difference $D_D$ is greater than second distance value $V_{D2}$, controller 46 knows that mobile machine 10 and/or shank 26 of ripper 18 are in close enough proximity to keep-out zone boundary $B_Z$ of at least one keep-out zone Z that ripper 18 needs to raised, but that mobile machine 10 and/or shank 26 of ripper 18 are not close enough to keep-out zone boundary $B_Z$ that machine speed V needs to be reduced. Method 600 then proceeds to step 614, where controller 46 issues one or more commands to raise ripper 18 and maintain machine speed V.

If distance difference $D_D$ is less than second distance value $V_{D2}$, method 600 then proceeds to step 616, in which controller 46 compares distance difference $D_D$ to third distance value $V_{D3}$, which is less than second distance value $V_{D2}$. If distance difference $D_D$ is greater than third distance value $V_{D3}$, then controller 46 knows that mobile machine 10 and/or shank 26 of ripper 18 are in close enough proximity to keep-out zone boundary $B_Z$ of at least one keep-out zone Z that ripper 18 needs to raised and that machine speed V needs to be reduced. Method 600 then proceeds to step 618, where controller 46 issues one or more commands to raise ripper 18 and reduce machine speed V.

If in step 616 distance difference $D_D$ is less than third distance value $V_{D3}$, method 600 then proceeds to step 620, in which controller 46 compares distance difference $D_D$ to fourth distance value $V_{D4}$, which is less than third distance value $V_{D4}$. If distance difference $D_D$ is greater than fourth distance value $V_{D4}$, then controller 46 knows that mobile machine 10 and/or shank 26 of ripper 18 are in close enough proximity to keep-out zone boundary $B_Z$ of at least one keep-out zone Z that mobile machine 10 must stop (i.e., machine speed V must be brought to zero), irrespective of whether ripper 18 is raised. Method 600 then proceeds to step 622, where controller 46 issues one or more commands to stop mobile machine 10 (i.e., reduce machine speed V to zero).

Other variations of method 600 are also contemplated and within the scope of the present disclosure.

INDUSTRIAL APPLICABILITY

In general, the systems, methods, and controllers of the present application are applicable for ensuring that a work tool of a surface-engaging implement, such as a shank of a ripper, does not enter a keep-out zone. The keep-out zone can be associated, for example, an obstruction that should be avoided or a soil type that does not need to be treated by the surface-engaging implement. By automating control of the surface-engaging implement in this manner, the systems, methods, and controllers of the present application allow for more efficient and safer control of the surface-engaging implement and the mobile machine to which it is mounted.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

The present disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context,

What is claimed is:

1. A mobile machine for operation at a work site having a work surface, the mobile machine comprising:

a frame;

a traction device mounted to the frame, the traction device being configured to move the mobile machine with respect to the work surface;

a surface-engaging implement mounted to the frame, the surface-engaging implement being raisable and lowerable with respect to the frame;

a first sensor configured to provide a machine speed of the mobile machine;

a second sensor configured to provide a machine location of the mobile machine; and a controller storing a three-dimensional site plan associated with the work site, the three-dimensional site plan including at least one keep-out zone, the controller being configured to receive the machine speed and the machine location, and, based on the machine speed and the machine location with respect to the at least one keep-out zone, to at least one of:

raise the surface-engaging implement and maintain the machine speed, raise the surface-engaging implement and reduce the machine speed, stop the mobile machine, or provide an indication to an operator of the mobile machine;

wherein the controller is further configured to:

determine a distance difference between the machine location and a boundary of the at least one keep-out zone, and raise the surface-engaging implement if the distance difference is less than a first distance value.

2. The mobile machine of claim 1, further comprising:

a frame arm connecting the surface-engaging implement to the frame, the frame arm having a frame arm angle with respect to the frame, wherein the surface-engaging implement comprises a work tool for penetrating the work surface, the work tool having a work tool angle with respect to the frame arm.

3. The mobile machine of claim 2, wherein the surface-engaging implement is rotatable about the frame arm, and wherein the controller is configured, based on the machine speed and the machine location with respect to the at least one keep-out zone, to vary at least one of the work tool angle or the frame arm angle.

4. The mobile machine of claim 3, wherein varying at least one of the work tool angle or the frame arm angle comprises increasing at least one of the work tool angle or the frame arm angle.

5. The mobile machine of claim 1, wherein the at least one keep-out zone comprises a portion of the work surface that includes at least one obstruction.

6. The mobile machine of claim 5, wherein the at least one obstruction is disposed in the work surface and/or under the work surface.

7. The mobile machine of claim 6, wherein the at least one obstruction comprises one or more buried utility lines.

8. The mobile machine of claim 1, wherein the controller is configured to raise the surface-engaging implement and maintain the machine speed if the distance difference is less than the first distance value and greater than a second distance value.

9. The mobile machine of claim 8, wherein the controller is configured to raise the surface-engaging implement and reduce the machine speed if the distance difference is less than the second distance value and greater than a third distance value.

10. The mobile machine of claim 9, wherein the controller is configured to stop the mobile machine if the distance difference is less than the third distance value and greater than a fourth distance value.

11. A method for operating a mobile machine at a work site having a work surface, the mobile machine including a surface-engaging implement for engaging the work surface, the surface-engaging implement being raisable and lowerable with respect to the mobile machine, the method comprising:

storing a three-dimensional site plan associated with the work site in a controller of the mobile machine, the three-dimensional site plan including at least one keep-out zone, receiving, by the controller, a machine speed of the mobile machine;

receiving, by the controller, a machine location of the mobile machine;

evaluating, by the controller, the machine speed and the machine location with respect to the at least one keep-out zone;

determining that a distance difference between the machine location and a boundary of the at least one keep-out zone is less than a first distance value; and in response, raising the surface-engaging implement.

12. The method of claim 11, wherein a frame arm connects the surface-engaging implement to a frame of the mobile machine, the frame arm having a frame arm angle with respect to the frame, wherein the surface-engaging implement comprises a work tool for penetrating the work surface, the work tool having a work tool angle with respect to the frame arm, the surface-engaging implement being rotatable about the frame arm, and wherein the method further comprises varying at least one of the work tool angle or the frame arm angle based on the machine speed and the machine location with respect to the at least one keep-out zone.

13. The method of claim 12, wherein varying at least one of the work tool angle or the frame arm angle comprises increasing at least one of the work tool angle or the frame arm angle.

14. The method of claim 11, wherein the at least one keep-out zone comprises a portion of the work surface that includes at least one obstruction.

15. The method of claim 14, wherein the at least one obstruction comprises one or more buried utility lines.

16. The method of claim 11, further comprising:

raising the surface-engaging implement and maintaining the machine speed if the distance difference is less than the first distance value and greater than a second distance value;

raising the surface-engaging implement and reducing the machine speed if the distance difference is less than the second distance value and greater than a third distance value; and stopping the mobile machine if the distance difference is less than the third distance value and greater than a fourth distance value.

17. A controller for a mobile machine having a surface-engaging implement raisable and lowerable with respect to the mobile machine, the controller being configured to:

store a three-dimensional site plan associated with a work site at which the mobile machine is operable, the three-dimensional site plan including at least one keep-out zone;

receive a machine speed of the mobile machine;

receive a machine location of the mobile machine; and evaluate the machine speed and the machine location with respect to the at least one keep-out zone, and in response:

raise the surface-engaging implement and maintain the machine speed, raise the surface-engaging implement and reduce the machine speed, stop the mobile machine, or provide an indication to an operator of the mobile machine;

wherein the controller is further configured to:

determine a distance difference between the machine location and a boundary of the at least one keep-out zone; and raise the surface-engaging implement if the distance difference is less than a first distance value.

18. The controller of claim 17, wherein the controller is configured to:

raise the surface-engaging implement and maintain the machine speed if the distance difference is less than the first distance value and greater than a second distance value;

raise the surface-engaging implement and reduce the machine speed if the distance difference is less than the second distance value and greater than a third distance value; and stop the mobile machine if the distance difference is less than the third distance value and greater than a fourth distance value.

19. The method of claim 16, wherein, if the distance difference is less than the third distance value and greater than the fourth distance value, the controller is further configured to raise the surface-engaging implement and cause the mobile machine to traverse the keep-out zone after stopping the mobile machine and raising the surface-engaging implement.

20. The method of claim 16, wherein, if the distance difference is less than the third distance value and greater than the fourth distance value, the controller is further configured to raise the surface-engaging implement and cause the mobile machine to traverse the keep-out zone after stopping the mobile machine and raising the surface-engaging implement.

* * * * *